US009333528B2

(12) United States Patent
DeCarr et al.

(10) Patent No.: US 9,333,528 B2
(45) Date of Patent: May 10, 2016

(54) PAINT ROLLER ASSEMBLY AND PAINTING PRODUCTS WITH SUPERHYDROPHOBIC CHARACTERISTICS

(71) Applicant: NOVA WILDCAT SHUR-LINE, LLC, Mooresville, NC (US)

(72) Inventors: Gary Allan DeCarr, Fort Mill, SC (US); Thomas Andrew Burdsall, Huntersville, NC (US); Anthony Harrell Best, Mooresville, NC (US)

(73) Assignee: NOVA WILDCAT SHUR-LINE, LLC, Mooresville, NC (US)

( * ) Notice: Subject to any disclaimer, the term of this patent is extended or adjusted under 35 U.S.C. 154(b) by 0 days.

(21) Appl. No.: 13/918,938

(22) Filed: Jun. 15, 2013

(65) Prior Publication Data

US 2013/0340192 A1 Dec. 26, 2013

Related U.S. Application Data

(60) Provisional application No. 61/660,640, filed on Jun. 15, 2012.

(51) Int. Cl.
*B05C 17/02* (2006.01)

(52) U.S. Cl.
CPC ..... *B05C 17/0225* (2013.01); *B05C 17/0212* (2013.01); *B05C 17/0227* (2013.01); *B05C 17/021* (2013.01); *B05C 17/0242* (2013.01)

(58) Field of Classification Search
CPC .. B05C 17/02; B05C 17/021; B05C 17/0207; B05C 17/0212; B05C 17/0222; B05C 17/0225; B05C 17/0227; B05C 17/023; B05C 17/0232; B05C 17/0242
USPC ..... 15/230.11, 248.2; 492/13, 19; D4/122, D4/123
See application file for complete search history.

(56) References Cited

U.S. PATENT DOCUMENTS

| | | | | | |
|---|---|---|---|---|---|
| 2,538,241 | A | * | 1/1951 | Guimond | 15/230.11 |
| 2,644,186 | A | * | 7/1953 | Guimond | 15/230.11 |
| 2,680,318 | A | * | 6/1954 | Simmons | 15/230.11 |
| 2,763,022 | A | * | 9/1956 | Glacken | 15/248.2 |
| 2,765,486 | A | * | 10/1956 | Anderson | 15/230.11 |
| 2,799,884 | A | * | 7/1957 | Bedford | 15/230.11 |
| 2,881,461 | A | * | 4/1959 | Parker | 15/230.11 |
| 3,623,180 | A | * | 11/1971 | Anderson | 15/230.11 |
| 3,649,986 | A | * | 3/1972 | Dahlund | 15/230.11 |
| 3,685,084 | A | * | 8/1972 | Bennett | 15/230.11 |
| 4,599,762 | A | * | 7/1986 | Rigter | 15/248.2 |
| 6,347,426 | B1 | * | 2/2002 | Weiss | 15/230.11 |
| 2005/0008872 | A1 | * | 1/2005 | Franchina et al. | 428/423.1 |
| 2006/0112509 | A1 | * | 6/2006 | Merten et al. | 15/207.2 |

FOREIGN PATENT DOCUMENTS

| | | | |
|---|---|---|---|
| CA | 2101124 | * | 1/1995 |
| DE | 1045870 | * | 12/1958 |
| EP | 765693 | * | 4/1997 |
| WO | 00/20125 | * | 4/2000 |
| WO | 00/38842 | * | 7/2000 |

* cited by examiner

*Primary Examiner* — Mark Spisich
(74) *Attorney, Agent, or Firm* — Mark T. Vogelbacker; Reed Smith LLP

(57) ABSTRACT

A paint roller assembly has a handle, a shaft with one end connected to the handle and an opposite end, and a roller head carried on the other end of the shaft. At least a portion of the paint roller assembly has a superhydrophobic surface.

15 Claims, 4 Drawing Sheets

10
12
14
16
18
20
22
24
30
32
34
40
42
44
44a
44b
46
48
50
52
54
56
60
62
70
72
74
76
78
80
81
82
84
A
4

PAINT ROLLER ASSEMBLY AND PAINTING PRODUCTS WITH SUPERHYDROPHOBIC CHARACTERISTICS

RELATED APPLICATION DATA

This patent is related to and claims priority benefit of U.S. provisional application Ser. No. 61/660,640 filed Jun. 15, 2012 and entitled "Paint Roller Assembly and Painting Products with Hydrophobic Characteristics." The entire content of this prior filed provisional application is hereby incorporated by reference herein.

BACKGROUND

1. Field of the Disclosure

The present disclosure is generally directed to painting products, and more particularly to a paint roller assembly configured to roll paint on a surface right up to an adjacent wall, corner, or trim piece and to painting products with components or surfaces to which paint does not adhere.

2. Description of Related Art

The walls of a typical room are painted in two basic steps. The edges of a wall to be painted typically terminate at or abut against door and window frame trim, floor or baseboard trim, a ceiling-to-wall corner, a wall-to-wall corner, and the like. The majority of a wall surface is typically painted using a conventional roller. The edges are typically cut in using a brush or other similar edging utensil. Sometimes, the surfaces of the adjacent wall, ceiling, or trim piece are taped off to prevent paint from contacting or adhering to such surfaces that are not to be painted. Taping off and cutting in or edging an entire room is typically an extremely time-consuming and labor intensive endeavor.

A typical paint roller assembly carries a cylindrical, elongate roller cover on a bearing element or cage. The exterior of the roller cover has a textured pile material for holding and releasing paint. The typical roller assembly also has a handle and a support arm extending from the handle. The support arm usually has an axle that carries the bearing element or cage. The axle typically protrudes from one end of the roller cover and the cage on the paint roller assembly and is connected to the support arm. The opposite ends of the roller cover and cage are free and typically exposed.

When the roller cover is repeatedly loaded with a supply of paint, the exposed faces and edges on the free ends of the roller cover and the cage also get covered with paint. Paint on the free ends of the roller cover and cage will be left on the adjacent trim, ceiling, or wall surfaces that are not to be painted. The structure of the end faces and end edges on the free end a typical roller cover and cage are also such that the roller cover is not capable of laying down or applying paint right up to the edge of the wall surface being painted. The typical paint roller assembly is not suitable for rolling paint right up to the edges of the wall surface being painted. Hence the need to cut in around the wall surface to be painted. If the roller assembly is flipped, a portion of the support or axle will instead contact the adjacent wall, ceiling, or trim surface that is not to be painted. This interference also prevents the roller cover from reading close up to the edge of the wall surface being painted. During use the exposed portion of the support arm or axle at the support arm end of the cage and roller cover also gets covered with paint, which can result in paint getting on the adjacent wall, ceiling, or trim piece even when the roller assembly is flipped.

Others have tried to improve upon or solve these difficulties in order to speed up the entire painting process and/or to simplify or eliminate the cutting in or edging process. Paint brushes with edger devices or guards have been devised that are intended to eliminate the need for taping off a room. Such brushes are at least intended to allow the user to more quickly cut in a room without having to be so precise. These types of solutions still require the room to be cut in separate from the process of rolling the majority of the wall surfaces. Paint roller assemblies have also been devised that include a shield on one or more ends of the roller portion. However, the shield will still become covered with paint when the roller assembly is dipped in a paint tray or other paint supply. See for example, U.S. Pat. No. 7,305,732. Such a shield has not been found to be very effective.

The more times a user dips or rolls a paint roller assembly in the paint supply, the more the parts of the assembly, other than the roller cover, becomes covered in paint. This can result in paint inadvertently dripping onto floor surfaces and other items in the room during painting. This can also result in unwanted paint getting on surfaces that are not to be painted but that are adjacent the wall surface to be painted. This can further make clean-up of the paint roller assembly more difficult and time consuming.

SUMMARY

In one aspect according to the teachings of the present disclosure, a paint roller assembly has a handle, a shaft with one end connected to the handle and an opposite end, and a roller head carried on the other end of the shaft. At least a portion of the paint roller assembly has a superhydrophobic surface.

In one aspect of the disclosure, the paint roller assembly can also have at least one axle at the opposite end of the shaft and at least one roller cover carried on the axle. The roller cover can have at least one exposed end face. A roller guard can be removably attachable to the roller head at the free end face of the at least one roller cover.

In one aspect of the disclosure, the paint roller assembly can have a roller guard that is magnetically attachable to a portion of the roller head.

In one aspect of the disclosure, the paint roller assembly can have a roller guard with a magnet. A portion the roller head can have a metal element adjacent a free end face of at least one roller cover. The magnet of the roller guard can be magnetically attachable to the metal element on the free end face.

In one aspect of the disclosure, the paint roller assembly can have a roller guard with an outward exposed surface on an end of a roller cover. The superhydrophobic surface can be at least on an outward exposed surface of the roller guard.

In one aspect of the disclosure, the roller head can include a roller cover with at least one free end and a roller guard removably attachable to the at least one free end of the roller cover. The roller guard can have a disc shaped body with an inner side that faces the at least one free end of the roller cover and an outer side that faces away from the at least one free end of the roller cover when attached thereto. The superhydrophobic surface can be at least on the outer side of the roller guard.

In one aspect of the disclosure, the roller head can include a roller cover with at least one free end and a roller guard removably attachable to the at least one free end of the roller cover. The roller guard can have a disc shaped body with an inner side that faces the at least one free end of the roller cover and can have an outer side that faces away from the at least one free end of the roller cover when attached thereto. The superhydrophobic surface can be at least on both the inner and outer sides of the roller guard.

In one aspect of the disclosure, the roller head can include a roller cover with at least one free end and a roller guard removably attachable to the at least one free end. The roller guard can have a disc shaped body with an inner side that faces the at least one free end and can have an outer side that faces away from the at least one free end of the roller cover when attached thereto. The disc shaped body can have a perimeter edge and the superhydrophobic surface can be at least on both the inner and outer sides and on the perimeter edge of the roller guard.

In one aspect of the disclosure, the superhydrophobic surface can be a coating on a portion of the paint roller assembly or can be an additive that has been added to a base material of a portion of the paint roller assembly.

In one aspect according to the teachings of the disclosure, a paint roller assembly has a handle, a shaft have one end connected to the handle and an opposite end, and a roller head at the opposite end of the shaft. The roller head has first and second axles that extend outward away from the shaft and from one another. A paint roller cover is rotatably carried on each of the first and second axles. Each paint roller cover has a tapered frusto-conical shape with a proximal end nearer the shaft and an opposite distal end. The proximal end has a diameter that is smaller than a diameter of the distal end. The first and second axles are oriented non-parallel with one another so that the paint roller covers can lie flat on a surface to be painted with the handle in a painting orientation relative to the surface to be painted.

In one aspect of the disclosure, each of the roller covers can be tapered at about a 5° relative to a central or rolling axis of the roller cover. The first and second shafts can be oriented directionally opposite one another at about 170° about an axis of the shaft.

In one aspect of the disclosure, the shaft can be formed of first and second bent wires, each extending from the handle at the one end.

In one aspect of the disclosure, the shaft can be formed of first and second bent wires extending from the handle. Independent portions of a length of the first and second wires can extend generally parallel and closely adjacent one another. The first and second wires can be detached from or not fixed to one another along the independent portions.

In one aspect of the disclosure, the shaft can be formed of first and second bent wires extending from the handle. Independent portions of a length of the first and second wires can extend generally parallel and closely adjacent one another. The first and second wires can be detached from or not fixed to one another along the independent portions. The first wire can have a bend of about 90° at the opposite end of the shaft and the first axle can be a continuation of the first wire beyond the bend. The second wire can have a bend of about 90° at the opposite end of the shaft and the second axle can be a continuation of the second wire beyond the bend. The independent portions of the first and second wires can be capable of resiliently flexing and torsionally twisting independent of one another.

In one aspect of the disclosure, the shaft can be formed of two bent wires, each extending from the handle at the one end. The first wire can have a bend of about 90° at the opposite end of the shaft and the first axle can be a continuation of the first wire beyond the bend. The second wire can have a bend of about 90° at the opposite end of the shaft and the second axle can be a continuation of the second wire beyond the bend.

In one aspect of the disclosure, the paint roller assembly can have at least one roller guard removably attachable to the roller head at a free end face of either of the paint roller covers.

In one aspect of the disclosure, the paint roller assembly can have at least one roller guard that can be magnetically attachable to the roller head at a free end face of either of the paint roller covers.

In one aspect of the disclosure, the paint roller assembly can have at least one roller guard that can be magnetically attachable to the roller head at a free end face of either of the paint roller covers. The roller guard can have a magnet and the roller head can have a metal element near the free end face of each of the paint roller covers to attract the magnet.

In one aspect of the disclosure, the paint roller assembly can have at least one roller guard removably attachable to the roller head at a free end face of either of the paint roller covers. The at least one roller guard can be magnetically attachable to the roller head and can have some radial play allowing the at least one roller guard to move radially as the paint roller covers rotate about the first and second axles.

In one aspect of the disclosure, the paint roller assembly can have two roller guards. Each roller guard can be removably attachable to the roller head at a free end face of a respective one of the paint roller covers.

In one aspect of the disclosure, the paint roller assembly can have at least one roller guard removably attachable to the roller head at a free end face of either of the paint roller covers. The at least one roller guard can have a disc shaped body with an outer side facing away from the free end face of the paint roller cover to which it is attached. At least the outer side of the at least one roller guard can have a superhydrophobic surface or surface characteristic.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present invention is directed to a paint roller assembly that solves or improves upon one or more of the above-noted and/or other problems and disadvantages with prior known paint roller assemblies and painting products and methods. In one aspect, the disclosed paint roller assembly has a split roller cover or applicator surface. In one aspect, the disclosed paint roller assembly has a split roller cover or applicator surface with two separate roller covers, each provided on an independent rolling axis that is offset or axially misaligned from the other. In one aspect, each roller cover is slightly cone shaped so that one portion of the roller cover surfaces can lie against a wall surface to be painted while the free ends of the roller covers and cages are tilted at an angle away from an adjacent trim, ceiling corner, or wall corner surface not to be painted. In one aspect, surfaces of the disclosed paint roller assembly can be coated, treated, or otherwise prepared having a superhydrophobic surface or surface characteristic so that paint does not adhere to such adjacent trim piece, wall corner, or ceiling corner surfaces. Such adjacent surfaces would not need clean up after painting and would not carry unwanted paint that could otherwise be applied or transferred unintentionally or dripped onto surfaces and objects not to be painted. In one aspect, a paint roller assembly or painting product can be provided with at least one super hydrophobic surface or at least one surface with a superhydrophobic characteristic. These and other objects, features, and advantages of the present disclosure will become apparent to those having ordinary skill in the art upon reading this disclosure.

Figure 1:
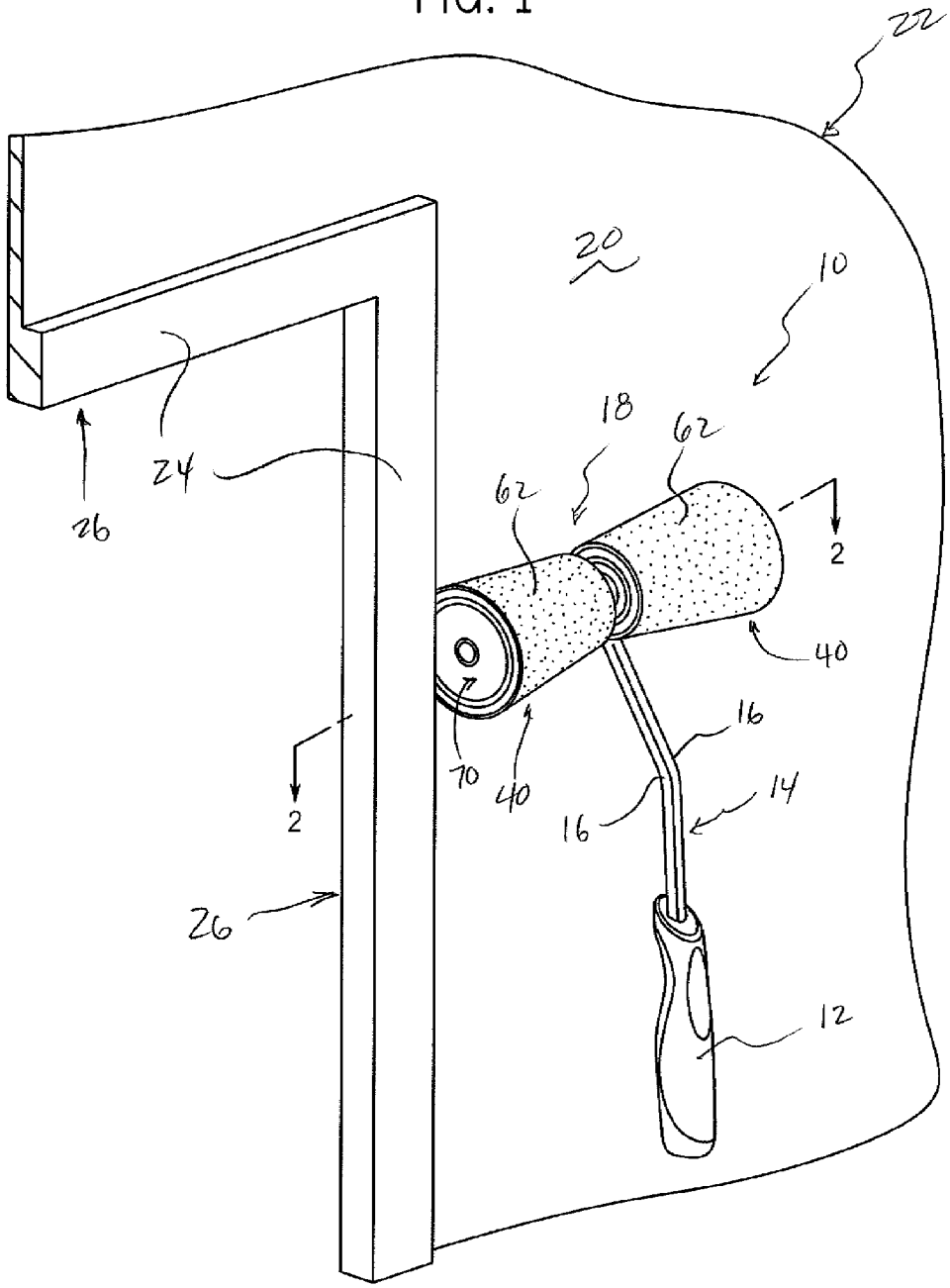
FIG. 1 shows a perspective view of one example of a paint roller assembly constructed in accordance with the teachings of the present disclosure, and against a wall surface to be painted.

Turning now to the drawings, FIG. 1 shows one example of a paint roller assembly 10 constructed in accordance with the teachings of the present disclosure. In one example, the paint roller assembly 10 can have a handle 12 configured for a user to grasp and manipulate the paint roller assembly during painting. The paint roller assembly 10 can also have a support arm extending from one end of the handle 12. The support arm in one example can have a shaft 14 formed of first and second wires 16. The two wires 16, or at least portions thereof, can extend parallel with one another and have one end connected to the handle 12 and an opposite end that carries an applicator or roller head 18. The roller head 18 can be oriented perpendicular to the shaft 14 and the shaft can be positioned at about the middle of the width of the roller head giving the paint roller assembly 10 a T-shaped configuration. The paint roller assembly 10 is shown in FIG. 1 positioned with the roller head 18 against a wall surface 20 to be painted. The wall surface 20 is part of a wall segment 22 that has trim pieces 24 surrounding a door opening 26 in the wall segment. A left side free end, as discussed in greater detail below, of the roller head 18 is positioned directly adjacent the trim piece 24 along the door opening 26 at an edge of the wall surface 20 in this example. Characteristics and features of the roller head 18 and paint roller assembly 10 are disclosed and described below. These features and characteristics are to aid in preventing unwanted paint transfer to the trim piece 24 while allowing the user to paint close up to the edge of the wall surface 20 adjacent the trim piece.

Figures 2, 4:
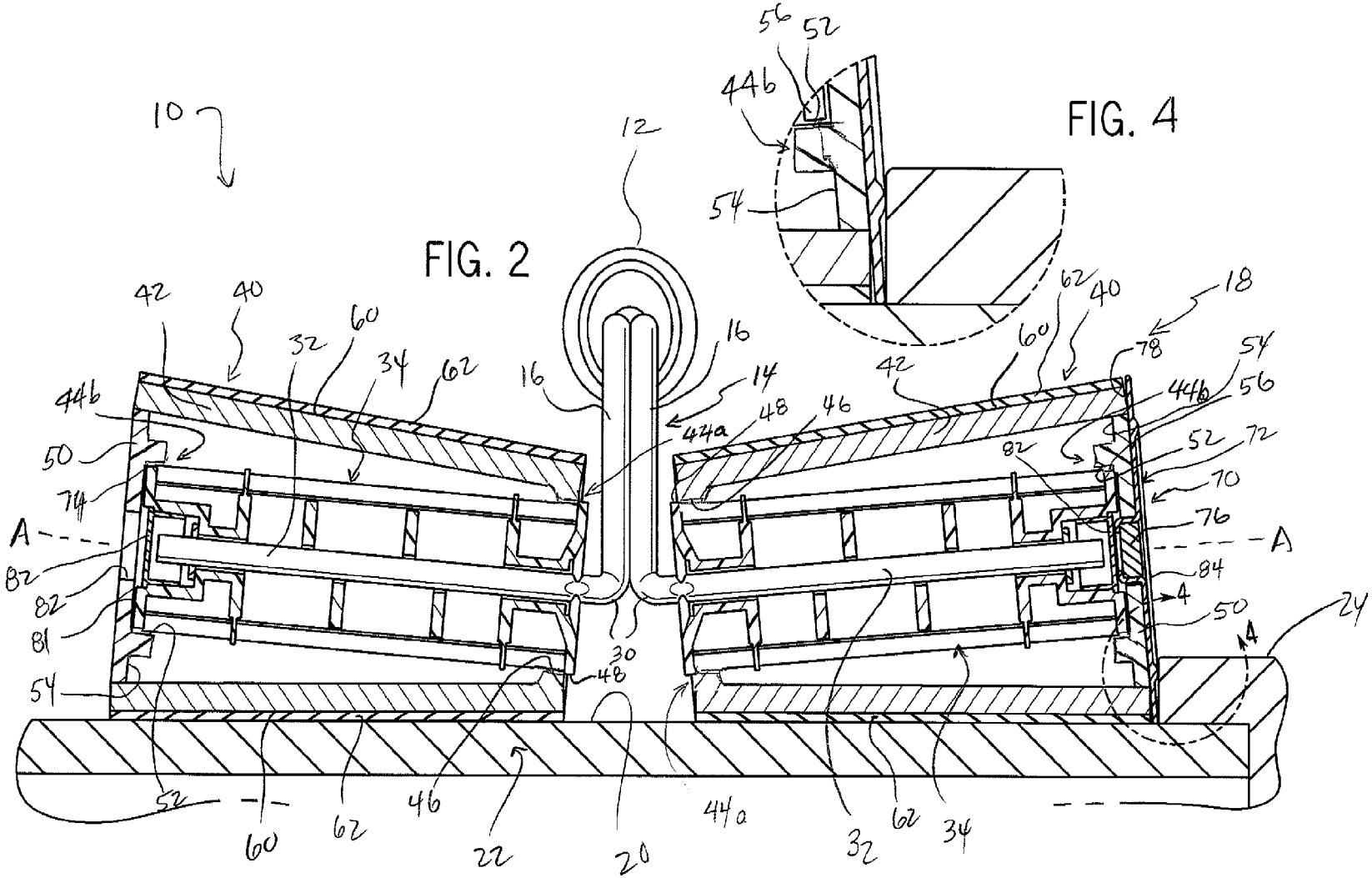
FIG. 2 shows a cross-section taken along line 2-2 of the paint roller assembly and wall surface shown in FIG. 1.
FIG. 4 shows an enlarged view taken from circle 4-4 of a portion of the paint roller assembly shown in FIG. 2.

FIG. 2 shows a cross-section of the paint roller assembly 10. The handle 12 can extend from and be connected to one end of the shaft 14 of the support arm. The shaft 14 can terminate at its other end in a T-shaped split axle arrangement. Specifically, each wire 16 of the shaft 14 can have a bend 30, such as a 90° bend, spaced from the one end carrying the handle 12. The bends 30 can direct the wires 16 outward and away from the other. Each wire 16 can continue from and beyond its respective bend 30 and from one another to form respective first and second roller axles 32. The split axle configuration has two separate axles 32 that extend in opposite directions from one another and away from the shaft 14. Each axle 32 can carry a separate roller bearing element, roller carriage, or cage 34 that can freely rotate about the corresponding axle. Each roller cage 34 can be a molded plastic ribbed structure that defines an outer cylindrical surface (see FIGS. 2 and 5) or a frusto-conical surface (not shown). Each cage 34 can be configured similar to a conventional paint roller cage, but split in two separate pieces, one for each axle 32, as shown herein.

Figure 3:
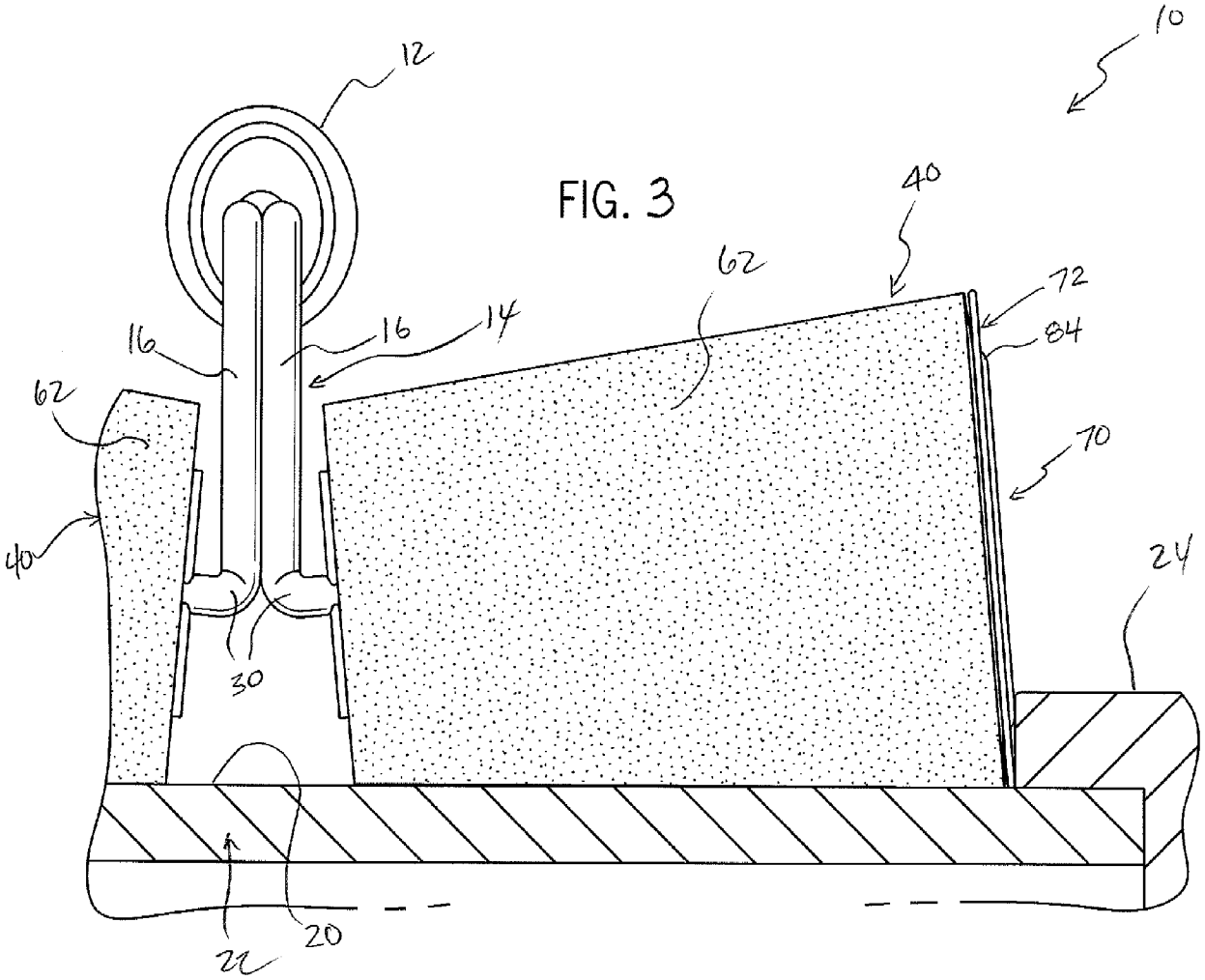
FIG. 3 shows an end view of a portion of the paint roller assembly shown in FIGS. 1 and 2.

The roller head 18 can have two roller covers 40 as shown in FIGS. 2 and 3 carried on the opposite end of the shaft 14. In one example, one of the roller covers 40 can be installed over each axle 32, and in this example, onto each of the roller cages 34. Each roller cover 40 can have a core 42 or tube structure that is configured to mount on and engage one of the roller cages 34. The cores 42 can be paper, cardboard, paperboard, plastic, metal, or the like, as is known in the art. The shape and configuration of each core 42 can vary as long as the outer surface provides the functional characteristics discussed below and as long as a mounting and axial alignment mechanism is present between the core the cage 34. In one example (not shown), the alignment mechanism can simply be that each core 42 have an interior surface that is shaped to snugly fit over the like shaped exterior surface of the corresponding cage 34. In such an example, the cage 34 and core 42 can each have mating or corresponding external and internal cylindrical shapes, respectively, or external and internal frusto-conical shapes, respectively, that will concentrically align and hold the roller cover 40 co-axial with the cage.

Alternatively or in addition, each core 42 can have a centering mechanism 44*a*, 44*b* at each end of the core that can concentrically align and hold the roller cover 40 co-axial with the cage 34. The centering mechanism 44*a* at the proximal end of each core 42 can be an opening 46 that is sized to snugly fit over one end 48 of the cage 34 closest to the bend 30 on the respective shaft 14. The other end of the roller cover 40 can have an end wall 50 that caps off the core 42. The centering mechanism 44*b* can be a socket 52 on an inside axial face 54 of the end wall 50 on the core 42. The socket 52 can be sized to snugly receive the other end 56 of the core 42 in the socket. As will become evident to those having ordinary skill in the art, the mechanism used to co-axially hold and align the cores 42 and roller covers 40 to one another can vary and yet function as intended. The purpose of the alignment mechanism is to maintain concentricity between cover and core so that the rollers roll true and smoothly with no offset or imbalance.

The roller covers 40 can be forcibly slid onto and removed from the roller cages 34 as needed and as is known in the art. Conventional paint roller assemblies have a single cylindrical carriage or cage that receives a single cylindrical roller cover. The roller covers 40 as disclosed herein can operate in a similar manner, even though the roller head 18 has two roller covers 40 and two roller cages, 34, and two axles 32. The only difference may be that the disclosed roller covers create a different roller head shape.

As shown in FIGS. 2 and 3, each core 42 has an exterior surface 60 that can carry a textured pile material 62 having a nap length and density. The type of pile material and the nap length and density can vary. The pile material can be formed from plastic or phenolic core fibers, mohair, wool, or other suitable materials that are adhered to the core. The textured pile material 62 is provided, as is known in the art, to hold paint on the exterior surface 60 of the roller cover 40 and to release paint to the wall surface 20 when the roller cover is rolled over the surface to be painted.

The configuration, contour, form, and construction of the handle, shaft, axles, and cages can vary from the example disclosed and described herein. The shape of the handle 12, shaft 14, and/or wires 16 can be altered. The shape and construction of the roller cages can also be altered. Numerous changes in the overall form of the paint roller assembly 10 can be made without detrimentally affecting the function of the disclosed paint roller assembly.

In one aspect of the disclosure, each roller cover 40 can have a tapered cylinder-like or frusto-conical shape as shown in FIGS. 2 and 3. The exterior surface 60 can be tapered at an angle such that the diameter of the roller cover 40 increases from the one end (proximal to the shaft 14) to the other free end (distal or spaced from the shaft). In one example, the exterior surface 60 of the core can be tapered at about a 5° angle relative to a center or rolling axis A of the roller cover 40. Each axle 32 can also be oriented at an angle relative to the other axle so that the axles 32 are not aligned parallel or co-linear with one another. In this example, the axles 32 are each oriented at an angle of about 5° relative to a flat wall surface, at least when the handle 12 is oriented at a desired in-use rolling angle relative to the wall surface 20. Put another way, the wires 16 can be axially "twisted" when attached to the handle 12 so that the axles 32 are oriented at about 170° relative to one another. In one example, the axles 32 can be at the maximum angle, such as 5°, when the handle 12 (and part of the shaft 14 in this example) is at about or generally parallel to the wall surface 20 to be painted. This can be seen in FIGS. 1 and 2. With the axles 32 oriented as described and the exterior of the roller covers 40 tapered as described, the roller covers 40 will both lie flat against the wall surface 20 when the handle 12 is oriented at a predetermined painting orientation during use. If the handle is not properly oriented, the roller covers 40 will be slightly tipped relative to one another and not lie flat on the wall surface 20.

The shaft 14, wires 16, bends 30, axles 32, roller cages 34, and/or roller cover cores 42 can be designed to impart or allow for a degree of angular float or movement of the roller covers 40 during use. This can allow the roller covers 40 to lie generally flat against the wall surface 20 during use, even if the orientation of the handle 12 varies somewhat from the predetermined desired orientation relative to the wall surface. A predetermined amount of flexibility can be achieved using one or more spring mechanisms or by allowing resilient torsional flexing and lengthwise bending in the shaft and wires, and/or axial flex in the axles, roller cages, and/or roller cover cores. Also, the nap length of the pile material 60 can be large enough to allow for some variation in the handle orientation during use while still allowing the pile material to contact the wall surface 20 to be painted over the length of the roller covers 40.

In the disclosed example, each axle 32 defines a separate rolling axis A for its corresponding roller cover 40. As noted above, the exterior surface 62 of each roller cover 40 lies flat against the wall surface 20 to be painted, as shown in FIGS. 2 and 3, when the handle 12 is generally parallel (i.e., at the predetermined painting orientation) to the wall surface. The shaft 14 in this example can be formed of the two wires 16 and each wire can be independently connected or fixed to the handle 12. Each wire 16 may then extend separately from the handle 12 and not be otherwise fixed, joined, welded, or otherwise connected to the other wire beyond the handle. However, it may be optional that selected portions of the wires 16 nearer the handle 14 be connected or fixed to one another and that selected portions spaced from the handle be independent or not connected to one another, if desired. Each wire 16 can then continue independently to form its own bend 30 and axle 32. The wire form construction of the shaft 14 can allow for some bending and twisting during use. The bending and twisting would independent in each wire over the portions that are not connected or joint to one another. When a user applies pressure to the roller head 18 while painting, even when the handle orientation varies from parallel (i.e., from the predetermined painting orientation) relative to the wall surface 20, the wire form structure of the shaft 14 can twist and bend a little to accommodate such movements and variations. This can help to keep the roller covers 40 and pile material 60 flat against the wall surface 20 being painted.

The relative angle of the roller cover exterior surfaces 62 and the angles of the axles 32 can vary from the example of a 5° angle as disclosed herein. An angle of less than 5° in many circumstances may not provide the desired degree of edge clearance as discussed below. However, an angle of less than 5° could be suitable in some circumstances. An angle of more than 5° will provide greater edge clearance, as defined and described below. However, a greater angle may limit the effective range of the handle orientation that results in the roller covers lying flat against the wall surface. The axle and roller taper angles may be varied from between about 2.5° to about 15°, for example.

The specific angled and tapered geometry of the axles 32 and roller covers 40, respectively, result in an edge clearance between the distal or free end face on each side of the roller head 18 and an adjacent wall, ceiling, or trim piece during painting. The 5° angle of the axles 32 and roller covers 40 tilts or angles each end face of the roller head 5° inward when the roller covers 40 lie flat against the wall surface 20, as shown in FIGS. 2-4. When a user paints the wall surface 20 and rolls up to a trim piece 24 (or an adjacent wall or ceiling), one of the roller covers 40 will sit adjacent the trim piece as depicted in FIGS. 3 and 4. The distal end face on that roller cover 40 tilts away from the trim piece 24. Thus, the very distal-most edge of the roller cover 40 can seat in the corner directly against the trim piece 24 and still lie against the wall surface 20 to be painted. The remaining face on the free end of the roller cover is angled or tilted away from and thus spaced from the adjacent trim piece 24, resulting in an edge clearance. The user can paint right up to the trim piece 24 (or adjacent wall or ceiling) without the need to edge or cut in that portion of the wall surface 20. The T-shape of the paint roller assembly 10 also allows a user to paint up to an adjacent wall, ceiling or trim piece using either side of the roller head 18. No part of the shaft 14 will interfere.

Figure 5:
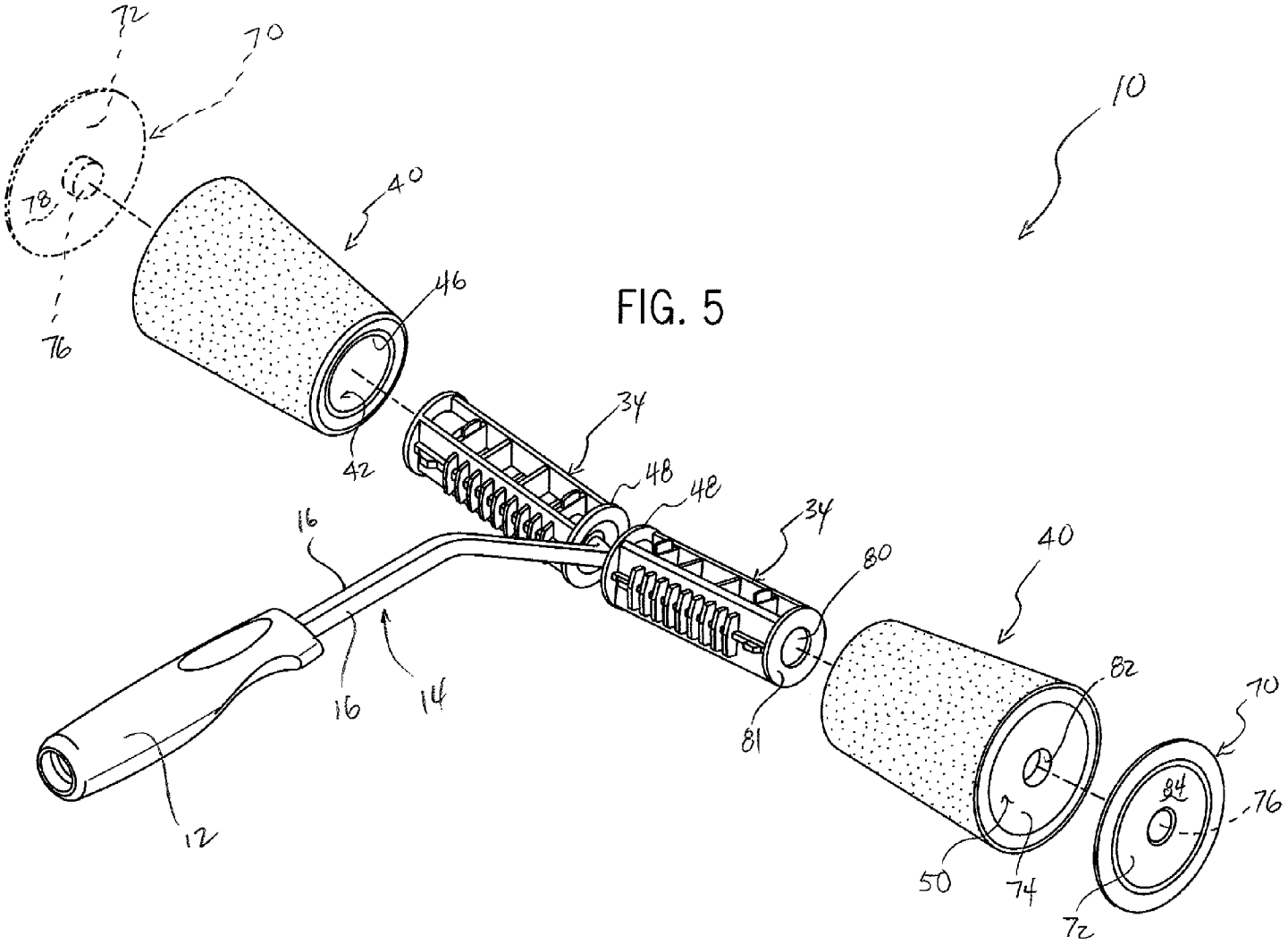
FIG. 5 shows a partially exploded view of the paint roller assembly shown in FIGS. 1 and 3.

In one aspect of the disclosure as shown in FIGS. 2 and 5, the paint roller assembly 10 can include one or more roller guards 70 that are attachable to and detachable from the free ends of the roller head 18. In one example, the paint roller assembly 10 can have one roller guard 70 that is selectively attachable to and removable from either one of the free ends of the roller head 18 as needed while painting. In another example, each free end of the roller head 18 can include a separate roller guard 70. If the user needs to roll up against an adjacent trim piece 24 or adjacent wall or ceiling on the right-hand free end of the roller head 18, the roller guard 70 can be applied to that end. Likewise, if the user needs to roll up against an adjacent trim piece or wall or ceiling on the left-hand free end of the roller head 18, the roller guard 70 can be applied to that end as needed.

As shown in FIG. 2, the roller guard 70 can be applied to the left-hand side roller cover 40 in this example in order to apply paint on the wall surface 20 right up to an adjacent trim piece 24 on the left-hand side of the paint roller assembly 10. The configuration and construction of the paint roller assembly 10 allows the outermost distal edge of the left-hand side roller cover 40 to seat in and apply paint right up to the edge of the wall surface 20. As shown in FIG. 5, the roller guard 70 can be applied to the right-hand side roller cover 40 to apply paint on the wall surface right up to an adjacent trim piece or wall surface positioned on the right-hand side of the paint roller assembly 10. In FIG. 5, the paint roller assembly 10 is shown with a roller guard 70 only in phantom on the left-hand side of the roller head as well.

In one aspect of the disclosure, the one or more roller guards 70 can each have a circular disc body 72. The disc body 72 can be sized to fit over the free end face of the roller head, such as an outside facing surface 74 on the end wall 50 of each roller cover 40. The disc body 72 can have a magnet 76 on or in an inner facing surface 78 of the body. Each roller guard 70 can also have a diameter about equal to that of the free end or end wall 50 of the roller cover 40. The size of the roller guard 70 can take into account some degree of compression of the textured pile material 60 on the roller cover 40. During use, the perimeter edge of the disc shaped body 72 should lie close the wall surface to be painted. A ferrous or other suitable metal element 80 such as a bar, plate, slug, or the like can be exposed on, accessible through, or embedded in the outside face 74 of the end wall 50 on the roller cover 40. In this example, the metal element 80 is provided on an end surface 81 of the cage 34. The magnet 76 can be attracted to the metal element 80 in order to removably secure the roller guard 70 to the end wall 50 on the desired side of the roller head 18. During use, the magnet 76 will retain the roller guard 70 attached to the roller head 18. In one example, the magnet 76 can protrude inward from the inside surface of the disc body 72 and can be a circular shape. A like shaped bore 82 can be provided in the outside face 74 on the end wall 50 and the metal element can be seated in the blind end of the bore, can surround the bore, or, as in this example, be accessible through the bore. The magnet can seat in the blind bore when attached to the roller cover to help keep the roller guard 70 concentrically aligned with the rolling axis A. The surfaces 74, 78 of the roller guard and the end wall can also include contours that aid in aligning or positioning the roller guard properly on the roller head.

The size, shape, location, and relative positioning of the magnet 76, metal element 80, and bore 82 (if provided), and the contour of the mating surfaces 74, 78 on the guard 70 and the end wall 50 can vary. The magnet can be provided on a part of the roller head and the metal element can be provided on the roller guard. These elements can be provided on the cage, or can be provided on the axle end, end wall of the roller cover, or the like. In one example, the magnet 76, metal element 80, bore 82, and mating surfaces can be designed to allow some tolerance or play to permit the roller guard to float radially during use. The roller guard 70 can be slightly oversized so that the perimeter edge may contact the wall surface 20 being painted, or ride in the corner between the wall surface and an adjacent trim piece 24 (or wall or ceiling) during painting. However, since the precise edge position of the roller guard 70 is not fixed and can float or move radially, firm pressure of the roller head 18 can always be applied against the wall surface. The roller guard 70 can be free to continually float off axis relative to the rolling axis of the roller cover 40. The size of the roller guard 70 can thus be large enough so that the perimeter edge always contacts the wall surface or corner, and yet float so as not to interfere with paint application to the wall surfaces.

The roller guard 70 can be used to help keep paint from getting on the adjacent trim pieces, wall, or ceiling during painting. The disclosed roller guard 70 can be removed when loading the roller covers 40 with paint, continually cleaned of paint as needed, and reinstalled on the roller head 18 when needed. The roller guard or guards 70 can be formed of any suitable material, but a plastic molded material would provide durability, low cost, flexibility, and scratch resistance characteristics during painting. The disclosed roller guards can also be used on the ends of a more conventional paint roller with a single roller cover and axle arrangement, if desired. Such a roller can have a handle, a shaft, and a roller head with at least one roller cover. One end face or both end faces of the roller cover can be configured to attach one of the disclosed roller guards thereto.

In the disclosed example, at least an outer side or surface 84 on the one or more roller guards 70 can be provided having a superhydrophobic surface, surface coating or characteristic. One example of a superhydrophobic coating is known as NEVERWET and is available from Ross Technology Corporation's Nanotechnology Division. Ross Technology Corporation has a number of pending applications, including U.S. publication no. 2013/0139309 and U.S. publication no. 2012/0045954, which disclose and describe various superhydrophobic coatings, additives, compositions, and manufacturing methods. The entire content of these publications is incorporated herein by reference.

In general, a hydrophobic coating or surface repels liquid. A hydrophobic surface or coating is one that results in a water droplet on a surface forming a surface contact angle that is about 90° or greater and less than about 150° at room temperature (i.e., about 18-23° C.). A superhydrophobic coating or surface is one that results in a water droplet on a surface forming a surface contact angle that is greater than 150° but less than a theoretical maximum angle of 180° at room temperature. Water is a Newtonian fluid. Paint is a non-Newtonian fluid that exhibits greater surface adhesion properties, as intended. A superhydrophobic coating or surface is needed in order for the paint to bead and roll off of a surface.

A superhydrophobic surface or coating completely repels water, heavy oils, and many other liquids, including paint. With such a surface coating or characteristic, paint will not stick to the roller guard(s) 70 during use. When the user loads the paint roller assembly with paint, the roller guard or guards 70 can remain installed on the roller head 18 and yet will remain free of paint. When the user then paints adjacent an edge or trim piece (see FIGS. 3 and 4), paint will not be transferred undesirably from the roller guard 70 onto the adjacent wall or ceiling surface or trim piece 24. As a result of this feature, in combination with the above described angled end faces on the roller covers 40 (see FIGS. 2 and 3), a user may paint a wall surface 20 close up and tight to the edges thereof. This can result in there being no need to tape off and/or cut in or edge the perimeter edges of the wall surface 20. Significant time and labor savings can be achieved.

All or portions of the surfaces of components of the paint roller assembly 10 can also be formed having the superhydrophobic coating or characteristic. These can include the axles 32, the roller cages 34, the magnets 76, the metal elements 80, the handle 12, the shaft 14, surfaces of the roller cores 42, and the like. This can make clean up very easy when a painting job is done. Paint will not stick or adhere to, or be easily removed from, any surface that is coated with the hydrophobic or superhydrophobic coating or that is fabricated with a hydrophobic or superhydrophobic surface characteristic. The superhydrophobicity can be added to a surface of a paint roller assembly by coating that surface with a suitable superhydrophobic composition. The coating can be sprayed on, wiped on, or otherwise applied to the desired surface. The superhydrophobicity can also be provided on a surface by including an additive or chemical composition in the base material that is used to mold or otherwise form the component. The resulting part formed of a material with such an additive will have superhydrophobic surfaces.

In addition, other paint products can have portions and/or surfaces that are formed having superhydrophobic surface characteristics or coatings, as noted above. For example, a conventional, single roller and axle paint roller assembly can have such a coating or surface characteristic on one or more parts of the assembly. Likewise, a paint tray can have at least its interior, paint receiving surface coated with a superhydrophobic coating. The paint tray would then be very easy to clean, since paint would not stick to the paint tray. Likewise, stir sticks could be fabricated with such a coating, particularly plastic stir sticks. The paint would then not stick to the paint stick when removed from stirring paint. In addition, the inside (and the outside, if desired) of a paint can and a paint can lid can also be coated with such a coating. Thus, all of the paint would be available to be poured from the can, resulting in no waste of paint. Further, paint brush handles and/or ferrules can also be coated with such a coating. The brush bristles themselves may even be capable of being coated. This would result in easy clean-up after use of the paint brush and would limit or prevent paint from sticking to portions of the brush that are not intended to hold paint. For all of these products, there would be little to no clean-up and little to no risk of unwanted paint transfer to surrounding objects and surfaces because no paint would be retained by the coated surfaces.

Although certain paint roller assemblies and roller configurations have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A paint roller assembly comprising:

a handle;

a shaft with one end connected to the handle and an opposite end;

a roller head carried on the opposite end of the shaft, the roller head including a first axle and a second axle, each axle extending outwardly from the shaft, the first and second axles being oriented non-parallel with one another;

at least one roller cover carried on each of the first and second axles, each roller cover having a tapered frusto-conical shape with a proximal end nearer the shaft and an opposite distal end, the proximal end having a diameter that is smaller than a diameter of the distal end, the distal end being an exposed end face; and a roller guard removably attachable to the roller head at the exposed end face of each roller cover, each roller guard being magnetically attachable to the roller head, wherein at least a portion of the paint roller assembly has a superhydrophobic surface at least on an outward exposed surface of the roller guard.

2. A paint roller assembly according to claim 1, wherein each roller guard has a magnet and the roller head has a metal element adjacent a free end face of each roller cover, each roller guard being magnetically attachable to one of the free end faces.

3. A paint roller assembly according to claim 1, wherein the superhydrophobic surface is on an inner facing side of at least one of the roller guards.

4. A paint roller assembly according to claim 3, wherein a disc shaped body of each roller guard has a perimeter edge and wherein the superhydrophobic surface is on the perimeter edge.

5. A paint roller assembly according to claim 1, wherein the superhydrophobic surface is a coating on a portion of the paint roller assembly or an additive to a base material of a portion of the paint roller assembly.

6. A paint roller assembly comprising:

a handle;

a shaft having one end connected to the handle and an opposite end;

a roller head at the opposite end of the shaft, the roller head including at least:

1) first and second axles, the first and second axles extending outward away from the shaft and from one another, and 2) a paint roller cover rotatably carried on each of the first and second axles, each paint roller cover having a tapered frusto-conical shape with a proximal end nearer the shaft and an opposite distal end, the proximal end having a diameter that is smaller than a diameter of the distal end; and a roller guard removably attachable to the roller head at the distal end of at least one of the paint roller covers to apply paint on a wall surface adjacent to a trim piece, wherein the first and second axles are oriented non-parallel with one another so that the paint roller covers can lie flat on a surface to be painted with the handle in a painting orientation relative to the surface to be painted.

7. A paint roller assembly according to claim 6, wherein the shaft comprises first and second bent wires, each extending from the handle at the one end.

8. A paint roller assembly according to claim 7, wherein independent portions of a length of the first and second wires extend generally parallel and closely adjacent one another, and wherein the first and second wires are not fixed to one another along the independent portions.

9. A paint roller assembly according to claim 8, wherein the first wire has a bend of about 90° at the opposite end of the shaft and the first axle is a continuation of the first wire beyond the bend, wherein the second wire has a bend of about 90° at the opposite end of the shaft and the second axle is a continuation of the second wire beyond the bend, and wherein the independent portions of the first and second wires can resiliently flex and torsionally twist independent of one another.

10. A paint roller assembly according to claim 7, wherein the first wire has a bend of about 90° at the opposite end of the shaft and the first axle is a continuation of the first wire beyond the bend, and wherein the second wire has a bend of about 90° at the opposite end of the shaft and the second axle is a continuation of the second wire beyond the bend.

11. A paint roller assembly according to claim 6, wherein the roller guard is magnetically attachable to the roller head.

12. A paint roller assembly according to claim 6, wherein the roller guard has a magnet and the roller head has a metal element near a free end face of each of the paint roller covers.

13. A paint roller assembly according to claim 6, wherein the roller guard is magnetically attachable to the roller head and has some radial play allowing the roller guard to move radially as the paint roller covers rotate about the first and second axles.

14. A paint roller assembly according to claim 6, further comprising two roller guards, each roller guard being removably attachable to the roller head at a free end face of each of the paint roller covers.

15. A paint roller assembly according to claim 6, wherein the roller guard has a disc shaped body with an outer side facing away from a free end face to which the roller guard is attached, wherein at least the outer side has a superhydrophobic surface characteristic.

* * * * *